United States Patent [19]

Halsey

[11] Patent Number: 4,742,796

[45] Date of Patent: May 10, 1988

[54] FENCE WIRE LOCATION MARKER

[76] Inventor: Larry L. Halsey, R.F.D., Wymore, Nebr. 68466

[21] Appl. No.: 917,694

[22] Filed: Oct. 10, 1986

[51] Int. Cl.[4] ..... G01D 21/00

[52] U.S. Cl. ..... 116/209; 116/200; 256/1; 256/4; D25/38; D25/45

[58] Field of Search ..... 40/1.5, 10 C, 11 A, 40/20 A, 21 R, 315, 316, 632; 116/63 R, 22 A, 173, 200, 209; 24/30.5 S; 33/126.5, 137; D11/98; D25/38, 45; 256/1, 4, 10, 32; 428/907, 4, 5, 28; 404/6; 211/54.1, 57.1, 59.1, 113; 248/214, 317, 339

[56] References Cited

U.S. PATENT DOCUMENTS

| | | | |
|---|---|---|---|
| 353,129 | 9/1886 | Gholson | 256/4 |
| 367,664 | 8/1887 | Riale | 256/4 |
| 405,851 | 6/1889 | Schlyer | 256/4 |
| 478,185 | 7/1892 | Barnum | 40/21 R |
| 2,622,553 | 12/1952 | Wilson | 116/209 |
| 3,215,385 | 11/1965 | Rockland | 248/317 |
| 3,304,038 | 2/1967 | Guthrie | 248/71 |
| 3,391,244 | 7/1968 | Moll | 174/40 R |
| 3,670,691 | 6/1972 | Anderson | 116/237 |
| 3,785,337 | 1/1974 | Flowerday | 116/209 |
| 4,109,605 | 8/1978 | Bächli | 116/22 A |
| 4,265,195 | 5/1981 | Higgins | 116/209 |
| 4,335,490 | 6/1982 | Teachout | 24/30.5 S |

FOREIGN PATENT DOCUMENTS

| | | | |
|---|---|---|---|
| 2627005 | 12/1977 | Fed. Rep. of Germany | 404/6 |
| 355021 | 8/1931 | United Kingdom | 40/316 |

*Primary Examiner*—William A. Cuchlinski, Jr.
*Assistant Examiner*—W. Morris Worth
*Attorney, Agent, or Firm*—Kinney & Lange

[57] ABSTRACT

An electric fence wire location indicator or marker includes a plastic tab mounted on the electric fence wire, and a brightly colored cloth-like streamer hanging from the tab. The tab is provided with a fence wire receiving opening 18. A slit from the opening to the outer edge of the tab provides a path for mounting the marker on the wire.

8 Claims, 1 Drawing Sheet

FENCE WIRE LOCATION MARKER

BACKGROUND OF THE INVENTION

1. Field of the Invention

This invention has relation to visual indicators or markers which can be mounted on or attached to generally horizontally extending electric fence wires to clearly show the location of such fence wires to prevent or deter livestock, wild life or persons walking, running, or operating vehicles such as farm vehicles, all terrain vehicles, or snowmobilies from inadvertently running into the wires to knock them down.

2. Description of the Prior art

The method of marking such electric fence wires or barbed wires today include tying strips of cloth at intervals along the wires, or placing aluminum beverage cans on the wires to mark the location of the fence, It is time consuming to mount beverage cans along the wires, and both the cans and the tied cloth are subject to slipping along the wire until stopped by a fencepost. This results in large spans of wire between the posts being unmarked. This frequency results in the unmarked fence being knocked down.

Others have attempted to develop structures which will be effective to solve the problems solved by the present invention, but none have found substantial commercial success inasmuch as none are known to the present applicant and those in privity to him to be available today in the marketplace.

U.S. Pat. No. 4,265,195, granted in May of 1981 to Higgins, discloses a marker for electric fence wire which includes a large thick block or plate 13 having a pair of parallel raised strips 20 and 21 defining a wire-pinching groove 19. Alternatively, a wire-pinching groove 14 is shown to be cut directly into the block or plate 13. A streamer is stapled to the top of the block, is wrapped around the block on the side opposite the wire-pinching grovoe, and extends through a large cylindrical opening through a lower portion of the block. This streamer seems to accomplish many of the purposes of the marker of the present invention; and it is suggested that the reason it has not found public acceptance that it is too bulky, complicated, and hence, too costly to provide an economically viable solution to the problem. Also, a collection of such markers will have appreciable bulk and appreciable weight and be difficult to carry and to install; and so will add a considerable and very undesirable weight load to the long spans of unsupported electric fence wire. This is particularly true in parts of the country where snow, ice and sleet loads can form on the relatively immobile blocks or plates 13.

The key to keeping down such snow, ice and sleet loads is movement of the wire and of markers placed along the wire. U.S. Pat. No. 3,391,244 was granted in July 1968 to Moll, and discloses a foreign material eliminator and aerial warning marker for electrically conductive wires. This precision made, relatively heavy, cumbersome structure does include, in FIG. 3, three or more vanes 15*a*, 15*b* and 15*c* which could be seen from some small distance. These vanes are firmly connected to a conducting wire such as wire 11 in such a manner that when snow or ice or sleet falls on the vanes, the wire conductor is twisted to allow the snow to fall from the vanes and also to clear it off of the conducting wire 11. Thsi invention was designed for marking and clearing overhead wires, not electric fence wires to restrain animals. It probably has not been adapted to use on electric fences for some of the same reasons that the teachings of the Higgins patent have not been universally accepted. These factors are weight, cost, bulk, etc.

The ancient U.S. Pat. No. 405,851 granted in june of 1889 to Schlyer, and U.S. Pat. No. 2,622,553 granted in December of 1952 to Wilson, show metal signals or discs adapted to be fastened to barbed wire fences by deforming part of the metal in the discs. Like the aluminum beverage cans now being used to attempt to accomplish the purposes of the invention, these discs are subject to being slid along the wires by the wind or by the rubbing of livestock against them. These structures are very difficult to see from any substantial distance, and their use is more effective on barbed wire fences where they cannot slide for much of a distance without coming in contact with one of the barbs. The low visibility factor keeps them from being widely accepted since there is no streamer such as seen in the patent to Higgins or such as seen in the structure of the present invention.

The ancient patent, U.S. Pat. No. 367,664 granted Aug. 2, 1887 to Riale, shows a metal strip to be installed on a barbed wire with a diagonally downwardly extending "thin hoop-iron" held in a vertical position to be visible by an anchor wire E which is tied or coiled around a lower parallel strand of fence. Obvisouly this structure will not be effective with electric fences because there is, typically, no second parallel wire running below the electric fence wire itself. If there was a second wire, there would be a severe drain or shorting of the electrical charge to ground, particularly in wet weather. Further, this structure has the disadvantages of the currently used aluminum beverage cans and the structures of the Schlyer and Wilson patents.

U.S. Pat. No. 3,785,337 discloses a warning device having a flat base and an integral strap extending from one edge of the base. The strap is looped around a strand of barbed wire and hangs loosely from below it. Evidently this structure would not be effective were it not for the closely spaced barbs to keep it from sliding quickly to one or the other of the fence post supporting the long reaches of electric fence wire.

A search was conducted on this invention and the foregoing patents were cited. Also cited was U.S. Pat. No. 3,304,038, granted in February of 1967 to Guthrie. It was cited merely to show the state of the art. It is not believed to be pertinent to this invention.

The inventor and those in privity with him are aware of no closer piror art than that discussed above and are aware of no prior art which anticipates the claims made herein.

SUMMARY OF THE INVENTION

A location indicator or marker for marking and indicating the location of substantially horizontally extending wires includes a generally planar tab or relatively thin, relatively stiff, but resilient and flexible material. The tab is provided with a wire-receiving opening through a central portion thereof. The opening has a minimum transverse dimension approximating the diameter of the wire which is to be marked, and has a slit open from the wire-receiving opening through to the outer periphery of the tab.

The tab can be of insulating material, but will also work effectively if conductive material is used.

The marker includes a flexible, easily seen, elongate, cloth-like streamer attached to the tab in spaced relation to the slit. The streamer will have sufficient mass to tend to position the tab so that the streamer attachment point remains generally between the tab wire-receiving opening and the bottom of the tab.

DETAILED DESCRIPTION OF THE PREFERRED EMBODIMENT

Figure 1:
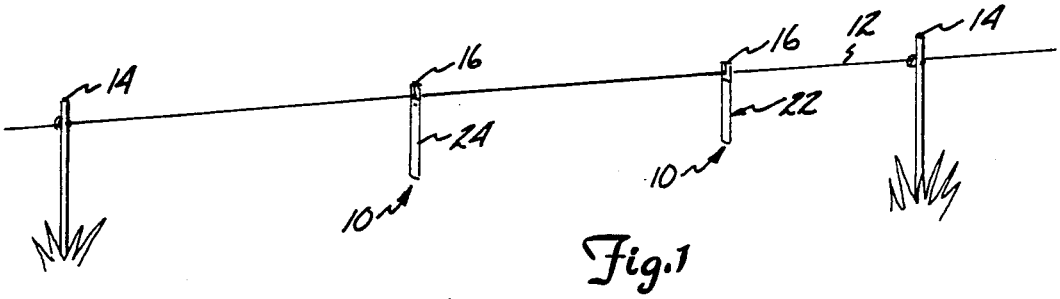
FIG. 1 is a perspective view of a post-supported electric fence wire with two fence wire location indicators or markers of the invention displayed thereon.
Figure 2:
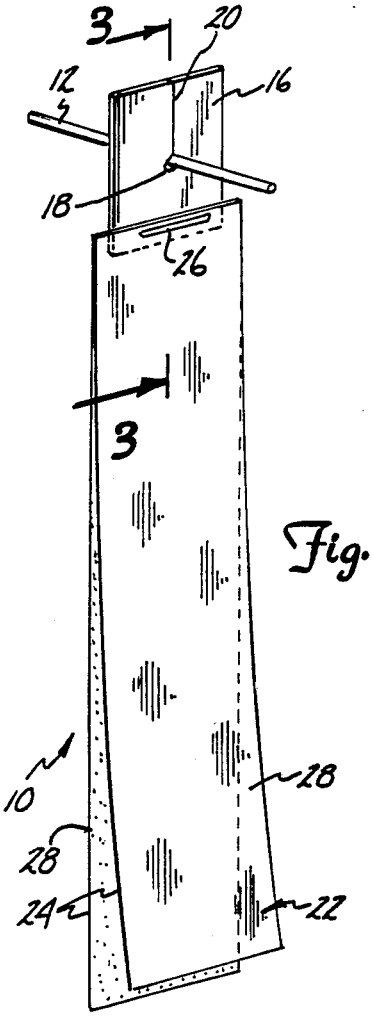
FIG. 2 is a perspective view of one of the markers of FIG. 1 showing its relationship to a generally horizontal electric fence wire on which it is installed.

A fence wire location indicator or marker 10 is for attachment to a generally horizontally extending fence wire 12 supported, for example, between fence posts such as 14.

The marker 10 includes a generally flat tab 16 of relatively thin, relatively stiff but resilient flexile material. Preferably, the tab can be of insulating material. It is provided with a wire-receiving opening 18 therethrough. A slit 20 in tab 16 extends from opening 18 to the outer periphery of the tab.

The marker also includes flexible, easily seen, elongate, cloth-like streamer means 22. As shown, this streamer means includes a single streamer 24 bent double and stapled as at 26 to a bottom portion of the rectangular tab 16. The outermost surface 28 of the streamer can be of a highly light reflective nature so that the streamer can be easily seen from all directions, and will thereby call attention to the location of the wire on which it is supported. Of course both the outer and inner surface can be of a highly light reflective nature, and this will make the marker even more easily visible as the streamer blows in the wind.

In order to install the marker, it is simply necessary to flex the tab 16 to bring the outermost ends of the slit 20 in spaced relation to each other, to position the wire 12 between the edges of the slit, and to push the tab toward the wire until the wire takes position in the opening 18.

If the diameter of the opening and the outer diameter of the wire are the same, the tab will grasp the wire and there will be no tendency for the marker to move along the wire toward either of the fence posts where it could not perform its function to visually indicate the positioning of the wire between posts.

Figure 3:
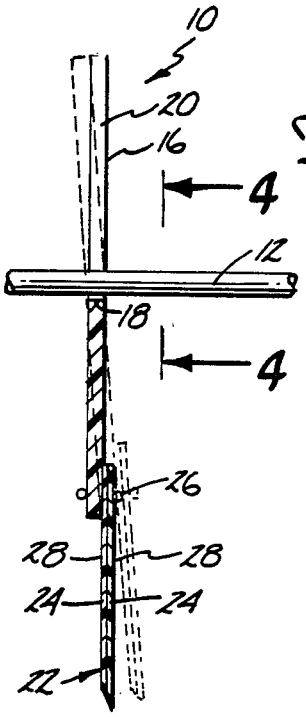
FIG. 3 is an enlarged, fragmentary, vertical sectional view taken on the line 2—2 in FIG. 2.
Figure 4:
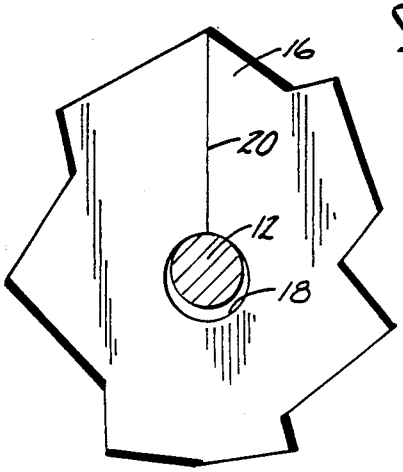
FIG. 4 is a fragmentary front elevational view of a portion of the marker of the invention as taken on the plane 4—4 in FIG. 3.

The marker 10 will not tend to move toward either fence post even when the wire 12 has a diameter slightly less than the diameter of tab opening 18. This relationship is seen in FIGS. 3 and 4 where the difference in the diameters is greatly exaggerated for clarity of illustration. As the wind hits the streamer 22 and the tab 16 of the marker 10, the larger surface area of the streamer will cause the tab to tend to tilt on the wire, thus pinching the wire between the upper edge and the lower edge of the tab opening 18, and effectively blocking any tendency for movement along the wire. In the usual case, the wind will not blow directly onto the marker in precise alignment with the longitudinal direction of the wire, and even if it did, the streamer 24, blowing in the wind, would cause the tab to tip or cock in such a manner as to pinch on the wire. Such a diagonal pinching of the wire is best illustrated in FIG. 4.

Many sizes and shapes of tabs 16 and streamers can be used to form markers made according to the present invention; but a location indicator or marker having the following dimensions has proved to be effective. A rectangular tab $1'' \times \frac{1}{4}''$ and 1/32nd" thick is provided with a wire-receiving opening of 1/16" diameter therethrough. Two streamers, each having an outwardly facing surface of highly light-reflective nature can be used, as can a single such streamer doubled over. Also, a single streamer having both surfaces of a highly light-reflective nature can be used.

In order to insure that the streamers can be visible on a generally horizontally sight line at right angles to the fence wire 12, the streamers can be wider than the tab so that they will tend to curl out of a plane perpendicular to such fence wire. For this purpose, streamers having a width of $\frac{7}{8}''$ and attached to a bottom portion of the $\frac{1}{4}''$ side of the tab have proved effective. Streamers which extend 7" from top to bottom have been found to be satisfacotry. Such streamers seem to give good visibility while not reaching unduly into weeds where they could serve to drain the electric charge from the fence wire in rainy or other moist and wet conditions.

Although the present invention has been described with reference to preferred embodiments, workers skilled in the art will recognize that changes may be made in form and detail without departing from the spirit and scope of the invention.

What is claimed:

1. A location indictor or marker for substantially horizontally extending fence wires includes:

(a) a generally planar tab of relatively thin, relatively thin, relatively stiff but resilient and flexible material, the tab being provided with:

(1) a wire-receiving opening through a central portion thereof, the opening having a a minimum transverse dimension not less than the diameter of a wire to be marked but approximating that diameter, and (2) a slit open from the wire-receiving opening through to the outer periphery of the tab, and operable upon flexing of the tab to be widened sufficiently to provide passage for the wire to be marked into the opening, the composition of the tab being such that when released from flexing the edges of the slit will return to a position so as to retain the wire to be marked within the tab opening until the tab is manually flexed so as to permit the wire to pass out through the slit; and (b) flexible, easily seen, elongate, cloth-like streamer means attached to the tab; whereby when the diameter of the wire-receiving opening of the tab equals the diameter of the wire, the tab grasps the wire and effectively blocks any tendency of the marker to be moved along the wire by wind; and when the diameter of the wire-receiving opening of the tab is slightly greater than the diameter of the wire, the streamer means, when hit by wind, causes the tab to tilt and pinch the wire between upper and lower edges of the wire-receiving opening and effectively blocks any tendency of the marker to be moved along the wire by the wind between the opening and outer periphery of the tab.

2. The marker of claim 1 wherein:

(c) the streamer means is attached to the tab between the wire-receiving opening and the outer periphery of the tab at a position diametrically opposite to where the slit is open to said opening.

3. The marker of claim 1 wherein:

(c) the streamer means includes at least one surface of a highly light-reflective nature.

4. The marker of claim 3 wherein:

(d) the streamer means includes two nominally oppositely facing surfaces each of a highly light-reflective nature.

5. The marker of claim 4 wherein:

(e) the streamer means includes what are effectively two streamers, each streamer fastened to the tab so as to have a surface of a highly light reflective nature nominally facing in an opposite direction from the highly light-reflective surface of the other.

6. The marker of claim 1 wherein:

(c) the wire-receiving opening in the tab is circular; and (d) the slit provided in the tab lies in a straight, radially extending line from the wire-receiving opening to the outer periphery of the tab.

7. The marker of claim 6 wherein:

(e) the tab is rectangular in peripheral configuration; and (f) the streamer means is fastened adjacent to one flat side edge of the tab in position such that the slit in the tab is open through an opposite, parallel, flat side edge of the tab.

8. The marker of claim 7 wherein:

(g) the streamer means is fastened to the tab by a staple extending through the tab and the streamer means.

* * * * *

UNITED STATES PATENT AND TRADEMARK OFFICE

CERTIFICATE OF CORRECTION

PATENT NO. : 4,742,796

DATED : May 10, 1988

INVENTOR(S) : Larry L. Halsey

It is certified that error appears in the above-identified patent and that said Letters Patent is hereby corrected as shown below:

Column 4, line 34, delete "indictor" and insert --indicator--; line 40, after "having", delete "a" (second occurrence); line 55, after "tab", insert --between the opening and outer periphery of the tab--; lines 66-67, after "wind", delete "between the opening and outer periphery of the tab".

Column 6, line 11, after "in" (first occurrence), insert --a--.

Signed and Sealed this

Twenty-fifth Day of October, 1988

*Attest:*

DONALD J. QUIGG

*Attesting Officer*

*Commissioner of Patents and Trademarks*